US008655219B2

(12) United States Patent
Tanaka

(10) Patent No.: US 8,655,219 B2
(45) Date of Patent: Feb. 18, 2014

(54) CLEANING DEVICE, CHARGING UNIT, IMAGE BEARING UNIT, AND IMAGE FORMING APPARATUS

(75) Inventor: Arichika Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 197 days.

(21) Appl. No.: 13/226,057

(22) Filed: Sep. 6, 2011

(65) Prior Publication Data

US 2012/0230722 A1 Sep. 13, 2012

(30) Foreign Application Priority Data

Mar. 7, 2011 (JP) ..... 2011-049109

(51) Int. Cl.
*G03G 15/02* (2006.01)

(52) U.S. Cl.
USPC ..... 399/100; 399/170; 399/171

(58) Field of Classification Search
USPC ..... 399/100, 170
See application file for complete search history.

(56) References Cited

U.S. PATENT DOCUMENTS 3,875,407 A * 4/1975 Hayne ..... 399/100
3,942,006 A * 3/1976 Hayne ..... 399/100
5,485,255 A * 1/1996 Reuschle et al. ..... 399/168
7,174,114 B2 * 2/2007 Gila et al. ..... 399/100
2007/0059026 A1 * 3/2007 Owens ..... 399/100
2008/0069577 A1 * 3/2008 Sakato et al. ..... 399/44
2008/0069586 A1 * 3/2008 Dangelmaier et al. ..... 399/100
2008/0159776 A1 * 7/2008 Tanase ..... 399/100
2008/0226334 A1 * 9/2008 Ohno et al. ..... 399/100
2010/0054793 A1 * 3/2010 Parks ..... 399/100
2010/0104315 A1 * 4/2010 Moser et al. ..... 399/100
2010/0158558 A1 * 6/2010 Hano ..... 399/100
2012/0224881 A1 * 9/2012 Matsushita et al. ..... 399/100
2012/0230721 A1 * 9/2012 Yamada et al. ..... 399/100

FOREIGN PATENT DOCUMENTS

JP 2000-267401 A 9/2000

* cited by examiner

*Primary Examiner* — Walter L Lindsay, Jr.
*Assistant Examiner* — David Bolduc
(74) *Attorney, Agent, or Firm* — Sughrue Mion, PLLC

(57) ABSTRACT

A cleaning device includes a device body, a cleaning member, and a support member. The device body is moved in a longitudinal direction of a plate-like grid member of a charging device. The cleaning member is disposed in the device body and cleans a first face of the grid member while pressing against the first face when the device body is moved. The support member is provided in the device body and has a support surface that is in contact with and supports a second face opposite to the first face of the grid member pressed by the cleaning member. The support surface is in contact with a mesh portion and a non-mesh portion of the grid member.

6 Claims, 8 Drawing Sheets

CLEANING DEVICE, CHARGING UNIT, IMAGE BEARING UNIT, AND IMAGE FORMING APPARATUS

CROSS-REFERENCE TO RELATED APPLICATIONS

This application is based on and claims priority under 35 USC 119 from Japanese Patent Application No. 2011-049109 filed Mar. 7, 2011.

BACKGROUND

(i) Technical Field

The present invention relates to cleaning devices, charging units, image bearing units, and image forming apparatuses.

SUMMARY

According to an aspect of the invention, there is provided a cleaning device including a device body, a cleaning member, and a support member. The device body is moved in a longitudinal direction of a plate-like grid member of a charging device. The cleaning member is disposed in the device body and cleans a first face of the grid member while pressing against the first face when the device body is moved. The support member is provided in the device body and has a support surface that is in contact with and supports a second face opposite to the first face of the grid member pressed by the cleaning member. The support surface is in contact with a mesh portion and a non-mesh portion of the grid member.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

Figure 1:
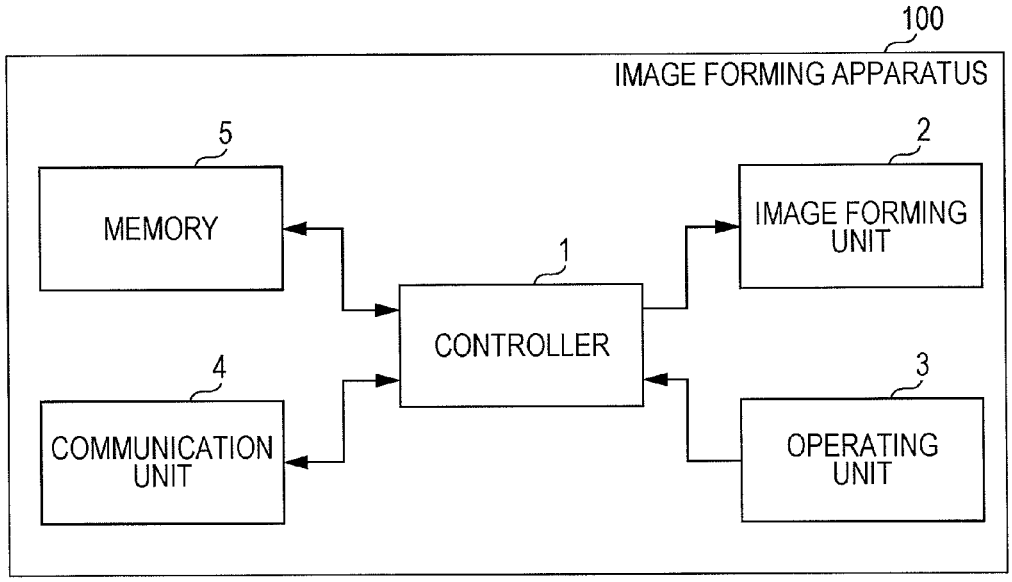
FIG. 1 illustrates the configuration of an image forming apparatus according to an exemplary embodiment of the present invention.

FIG. 1 illustrates the configuration of an image forming apparatus 100 according to an exemplary embodiment of the present invention. As shown in FIG. 1, the image forming apparatus 100 includes a controller 1, an image forming unit 2, an operating unit 3, a communication unit 4, and a memory 5.

The controller 1 includes an arithmetic unit, such as a central processing unit (CPU), and a memory. The arithmetic unit of the controller 1 executes a control program stored in the memory so as to control each unit included in the image forming apparatus 100. The image forming unit 2 forms an image on a recording medium by using toner as colorant. The recording medium is, for example, recording paper, but may alternatively be a plastic sheet, such as an OHP sheet, or a sheet composed of other materials. The image forming unit 2 forms an image by an electrophotographic process using toners of four colors, which are yellow (Y), magenta (M), cyan (C), and black (K).

The operating unit 3 includes an operating member, such as a button, and supplies operational information corresponding to user's operation to the controller 1. The communication unit 4 includes an interface for exchanging data with an external device. The memory 5 includes a storage device, such as a hard disk drive (HDD), and stores, for example, image data for forming an image.

Figure 2:
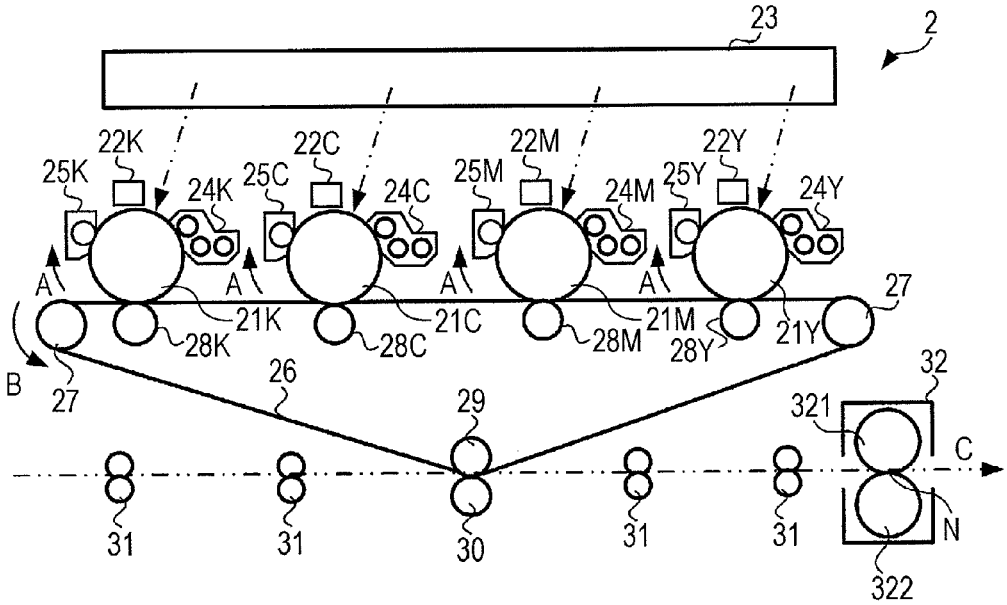
FIG. 2 illustrates the configuration of an image forming unit.

FIG. 2 illustrates the configuration of the image forming unit 2.

In FIG. 2, an alphabetical character given as a suffix to each reference numeral indicates the color of toner that the component given the reference numeral handles. Components with the same reference numeral but different alphabetical characters as suffixes handle different colors of toner but have the same configuration. In the following description, the alphabetical characters given as suffixes to the reference numerals will be omitted if it is not particularly necessary to distinguish between these components.

In FIG. 2, the recording paper transported within the image forming apparatus 100 is transported in a direction indicated by a dashed arrow C, and an image is formed on this recording paper.

Each of photoconductor drums 21 is a cylindrical member with a photoconductive film formed on a surface thereof. The photoconductor drum 21 bears an electrostatic latent image formed on the surface thereof. When in contact with an intermediate transfer belt 26, the photoconductor drum 21 rotates in a direction indicated by an arrow A about the center of the cylinder as an axis as the intermediate transfer belt 26 moves.

The photoconductor drum 21 is an example of an image bearing member according to an exemplary embodiment of the present invention.

Each of charging devices 22 is, for example, a scorotron charger and electrically charges the photoconductive film of the corresponding photoconductor drum 21 to a predetermined potential. An exposure device 23 exposes the photoconductor drum 21 electrically charged by the charging device 22 to light so as to form a latent image according to the exposure light. Each of developing devices 24 has a developer that contains a toner of one of Y, M, C, and K colors and a magnetic material, such as ferrite powder. The developing device 24 develops the latent image formed on the corresponding photoconductor drum 21 by adhering the toner thereto so as to form a toner image. Each of cleaning units 25 removes residual toner from the corresponding photoconductor drum 21.

The intermediate transfer belt 26 is an endless belt member and rotates in a direction indicated by an arrow B while being in contact with rotating rollers 27, first-transfer rollers 28, and a backup roller 29. The rotating rollers 27 are cylindrical members that support the movement of the intermediate transfer belt 26, and each rotate about the center of the cylinder as an axis. The first-transfer rollers 28 are cylindrical members that face the corresponding photoconductor drums 21 with the intermediate transfer belt 26 interposed therebetween. Each first-transfer roller 28 creates a potential difference with the corresponding photoconductor drum 21 so as to transfer the toner on the surface of the photoconductor drum 21 to the surface of the intermediate transfer belt 26.

A second-transfer roller 30 transfers the image obtained as a result of the development process performed by the developing devices 24 onto the recording paper. The second-transfer roller 30 is a cylindrical member that faces the backup roller 29 with the intermediate transfer belt 26 interposed therebetween. The second-transfer roller 30 creates a potential difference with the backup roller 29 so as to transfer the toner on the surface of the intermediate transfer belt 26 onto the surface of the recording paper. Transport rollers 31 are cylindrical members that are driven by a driving device (not shown) and that transport the recording paper in the direction of the dashed arrow C shown in FIG. 2. The transport rollers 31 are rotated so as to transport the recording paper at a predetermined transport rate.

The second-transfer roller 30 is an example of a transfer member according to an exemplary embodiment of the present invention.

A fixing device 32 includes a fixing roller 321 and a pressing roller 322. The fixing device 32 performs a fixing process on the transported recording paper with the image transferred thereon by applying heat and pressure to the recording paper at a nip region N between the fixing roller 321 and the pressing roller 322, thereby fixing the image onto the recording paper.

Figure 3:
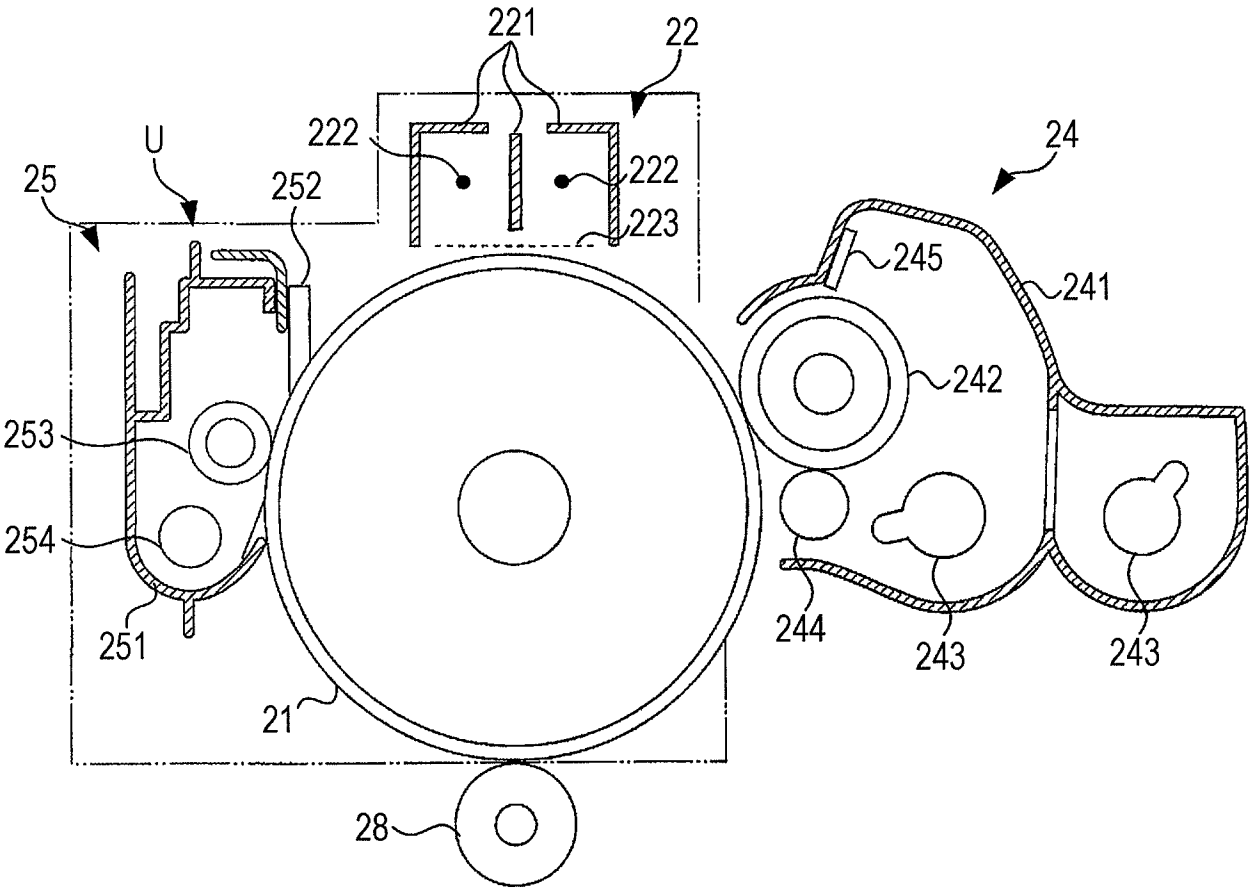
FIG. 3 is an enlarged view of a photoconductor drum and peripheral devices thereof.

FIG. 3 is an enlarged view of each photoconductor drum 21 and peripheral devices thereof.

In FIG. 3, the charging device 22 includes a charge container 221, two discharge wires 222, and a grid member 223. The charge container 221 is disposed in a non-contact manner above the photoconductor drum 21 and extends in the axial direction of the photoconductor drum 21. Furthermore, the charge container 221 is composed of a material that blocks off electric discharge, and substantially has an E shape in cross section that opens toward the photoconductor drum 21.

Although the charge container 221 is formed to substantially have an E shape in cross section for accommodating the two discharge wires 222, the charge container 221 may alternatively be formed to substantially have a U shape in cross section if the charge container 221 is to accommodate only one discharge wire 222.

The discharge wires 222 are electrically charging wires disposed in the longitudinal direction of the charge container 221. Each discharge wire 222 is tensely bridged between insulating members (not shown) disposed at opposite longitudinal ends of the charge container 221 by providing at least one end with a tension-applying elastic spring (not shown). Furthermore, the discharge wires 222 are connected to a discharge bias power source (not shown). The discharge wires 222 supply electric charge to the photoconductor drum 21.

The discharge wires 222 are composed of, for example, tungsten, carbon-tungsten, or gold-plated tungsten. The discharge wires 222 each have a diameter ranging between, for example, 30 μm and 40 μm, and the tensile force thereof ranges between, for example, 30 gf and 80 gf (0.29 N and 0.78 N). The number of discharge wires 222 may be one or three or more. In place of the discharge wires 222, sawtooth electrodes or needle electrodes may be used as discharge electrodes.

The discharge wires 222 are an example of a discharge member according to an exemplary embodiment of the present invention.

The grid member 223 is a plate-like member that is disposed in the opening of the charge container 221 at a position away from the photoconductor drum 21. Opposite longitudinal ends of the grid member 223 are attached to end members (not shown) disposed at the opposite longitudinal ends of the charge container 221. The grid member 223 regulates a charge amount from the discharge wires 222 so as to control the charged potential on the surface of the photoconductor drum 21. The grid member 223 is composed of, for example, tungsten, carbon-tungsten, or gold-plated tungsten, and has a width of, for example, 30 mm.

Figure 4:
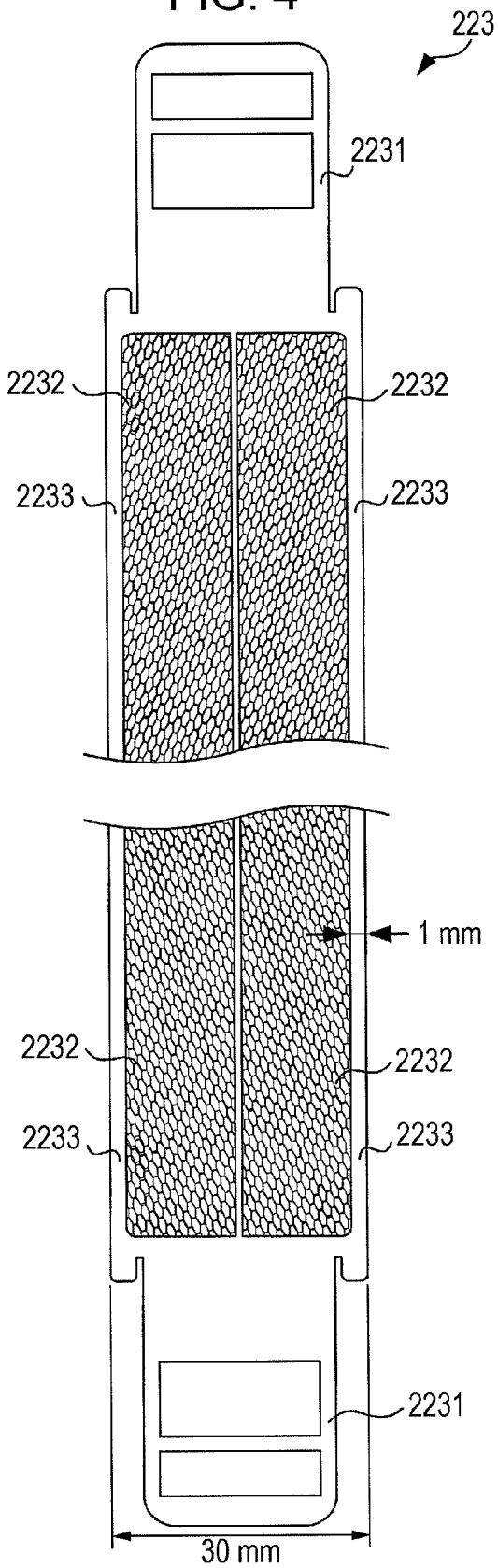
FIG. 4 illustrates an example of a grid member.

FIG. 4 illustrates an example of the grid member 223. As shown in FIG. 4, the grid member 223 has a metallic plate portion 2231, a mesh portion 2232, and a non-mesh portion 2233. The metallic plate portion 2231 is to be attached to the end members (not shown) disposed at the opposite longitudinal ends of the charge container 221. The mesh portion 2232 has a repeating hexagonal hole pattern. The non-mesh portion 2233 is formed so as to extend toward the opposite longitudinal ends of the grid member 223, and has a width of, for example, 1 mm.

The shape of the holes in the mesh portion 2232 may alternatively be rectangular, circular, or ellipsoidal.

The developing device 24 shown in FIG. 3 has a developing roller 242, a stirring-transport member 243, a developer supplying roller 244, and a regulating member 245 within a developer container 241. The developing roller 242 holds a toner on the surface thereof and transports the toner to a developing area that faces the photoconductor drum 21. The stirring-transport member 243 stirs and transports the toner contained in the developer container 241. The developer supplying roller 244 supplies the toner stirred and transported by the stirring-transport member 243 to the surface of the developing roller 242. The regulating member 245 regulates a layer thickness of the toner held on the developing roller 242.

The cleaning unit 25 shown in FIG. 3 has a cleaning blade 252. Moreover, the cleaning unit 25 has a cleaning brush 253 and a transport member 254 within a cleaning container 251. The cleaning blade 252 brings an edge thereof in pressure contact with the surface of the photoconductor drum 21 so as to scrape off a residue therefrom. The cleaning brush 253 brushes off the residue from the photoconductor drum 21. The transport member 254 transports the residue removed by the cleaning blade 252 and the cleaning brush 253 outward from the cleaning container 251.

Figure 5:
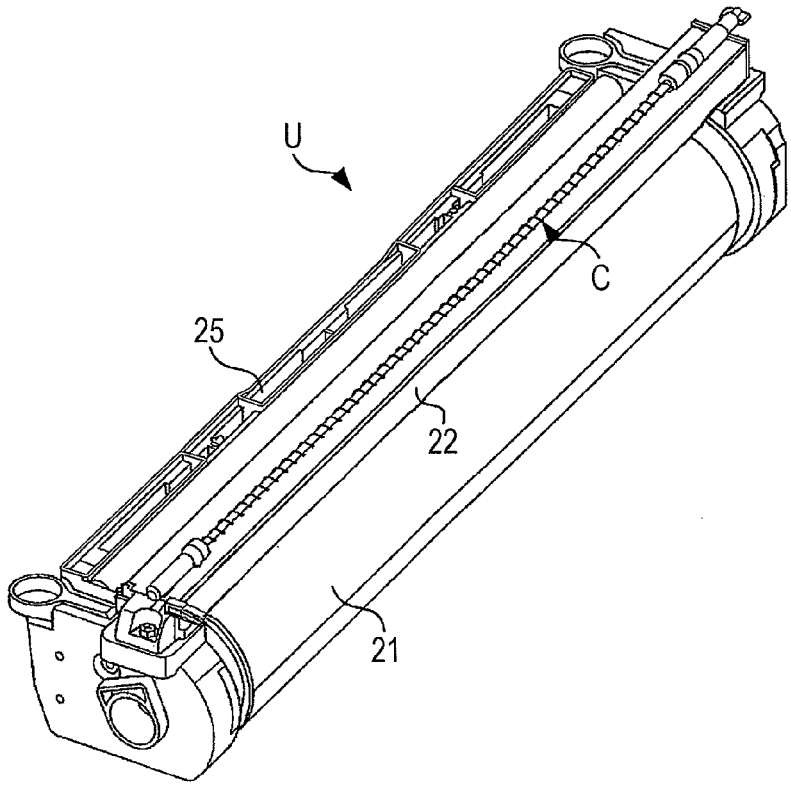
FIG. 5 is a perspective view illustrating an example of an image bearing unit.

The photoconductor drum 21, the charging device 22, and the cleaning unit 25 shown in FIG. 3 are integrated into a single unit as an image bearing unit U (see a two-dot chain line in FIG. 3). FIG. 5 is a perspective view illustrating an example of the image bearing unit U. In addition to the photoconductor drum 21, the charging device 22, and the cleaning unit 25, the image bearing unit U shown in FIG. 5 includes a cleaning mechanism C for cleaning the charging device 22.

Figure 6:
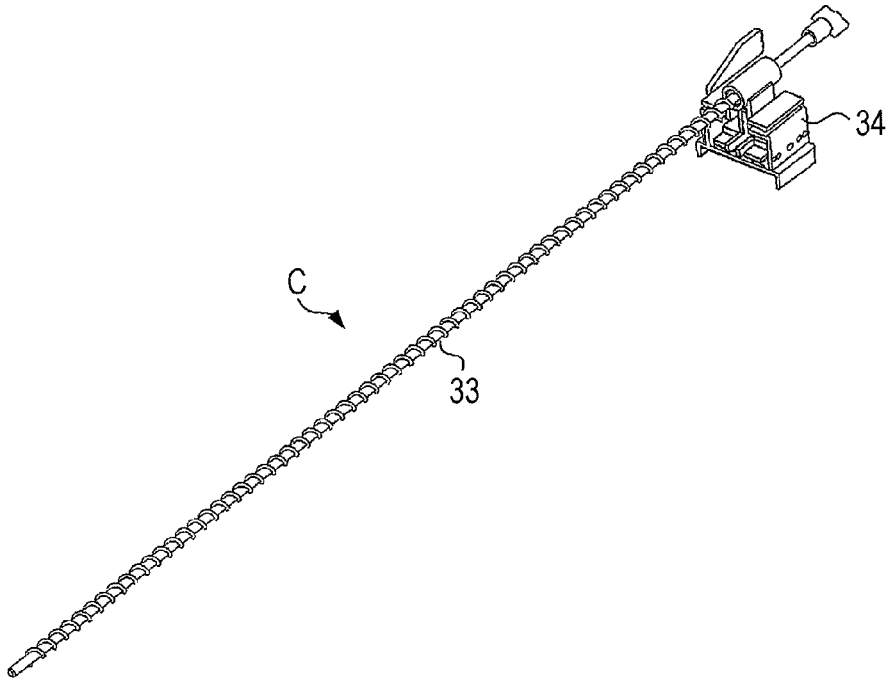
FIG. 6 is a perspective view illustrating an example of a cleaning mechanism.

FIG. 6 is a perspective view illustrating an example of the cleaning mechanism C. As shown in FIG. 6, the cleaning mechanism C includes a cleaner shaft 33 and a cleaning device 34.

The cleaner shaft 33 is a rod-like member with a helical groove formed around the surface thereof. Opposite longitudinal ends of the cleaner shaft 33 are attached to the end members disposed at the opposite longitudinal ends of the charge container 221 (see FIG. 5). Furthermore, the cleaner shaft 33 is connected to a motor (not shown) that is rotatable in forward and reverse directions, and rotates by receiving a driving force from this motor.

Figure 7:
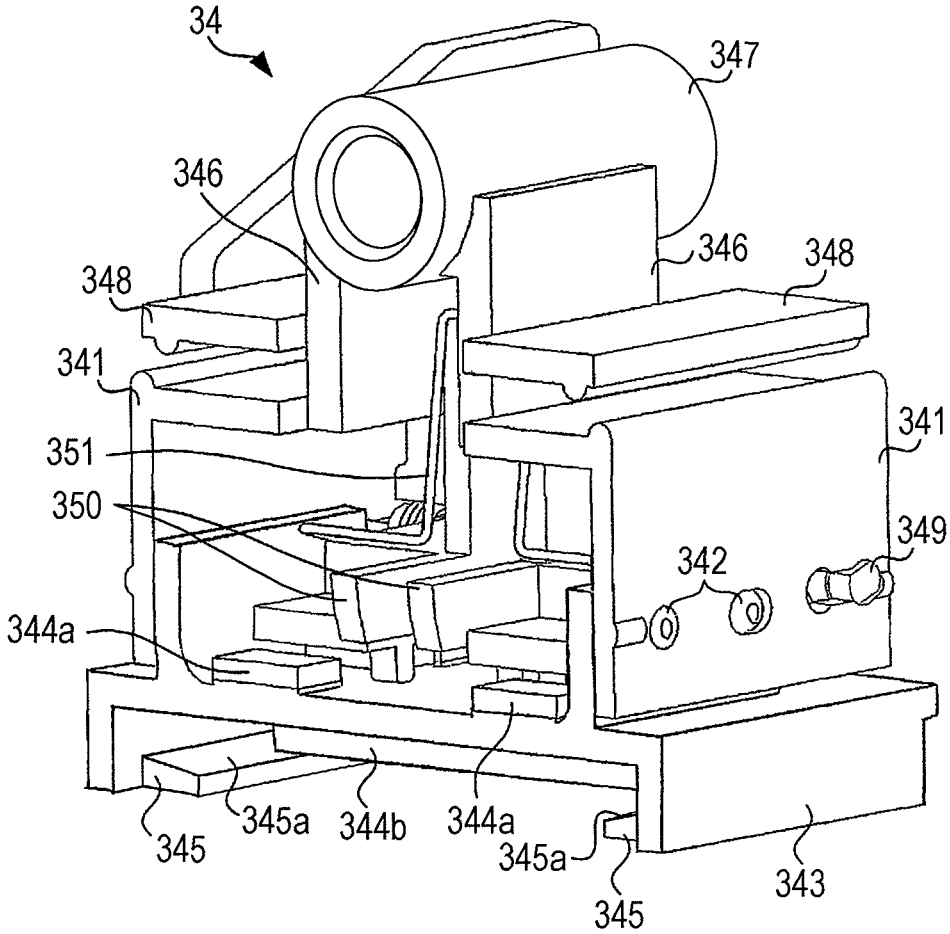
FIG. 7 is an enlarged view of a cleaning device shown in FIG. 6.
Figure 8:
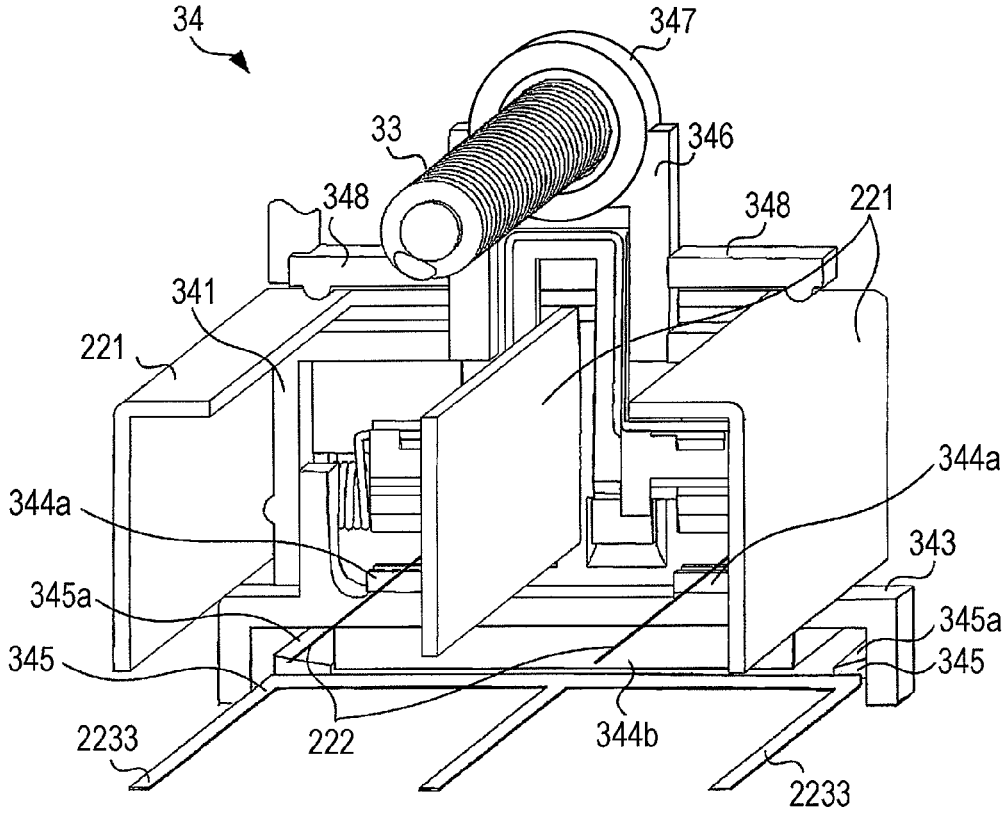
FIG. 8 illustrates the relationship between the cleaning device and a charging device.

FIG. 7 is an enlarged view of the cleaning device 34 shown in FIG. 6. FIG. 8 illustrates the relationship between the cleaning device 34 and the charging device 22. The cleaning device 34 shown in these drawings has a substantially inverted-U-shaped support frame 341 that is slidably movable in the longitudinal direction of the charge container 221. The support frame 341 is provided with attachment holes 342 and is coupled to a cleaning member 343 via securing members inserted in the attachment holes 342. Cleaning pads 344*a* and 344*b* are respectively attached to an upper surface and a lower surface of the cleaning member 343. The cleaning pads 344*a* are disposed in contact with the discharge wires 222 so as to remove discharge products adhered to the discharge wires 222. The cleaning pad 344*b* is disposed in contact with the grid member 223 so as to remove a discharge product adhered to the grid member 223.

The cleaning pads 344*a* and 344*b* are each formed by, for example, bonding a nonwoven fabric onto a porous elastic base material having flexibility and then forming a powder layer over the nonwoven fabric. Examples of the elastic base material include a sponge, felt, and resin foam. The nonwoven fabric is formed by bonding fibers together or entwining fibers. The powder layer includes a mixture of an adhesive and an abrasive having a polishing function, such as alumina, carborundum, or diamond.

Each of the cleaning pads 344*a* and 344*b* may alternatively be a flocked brush-like member.

The cleaning pad 344*b* is an example of a cleaning member according to an exemplary embodiment of the present invention.

The cleaning member 343 is also provided with a pair of support members 345, which are plate-like members. The support members 345 are disposed so as to support the grid member 223 from the lower surface thereof. When the grid member 223 is being pressed and cleaned from above by the cleaning pad 344*b*, the support members 345 prevent the grid member 223 from coming into contact with the photoconductor drum 21. Each support member 345 has a support surface 345*a* that is in contact with the grid member 223 and that is inclined toward the cleaning pad 344*b*. The inclination angle is, for example, 10° relative to the width direction of the grid member 223 (i.e., left-right direction in FIG. 4) when not pressed by the cleaning pad 344*b*.

The support members 345 are an example of a support member according to an exemplary embodiment of the present invention.

The support frame 341 is also provided with a pair of protruding arms 346, which are plate-like members. The two protruding arms 346 protrude from a guide groove, which is formed at the top of the charge container 221 and extends in the longitudinal direction thereof, and are slidably movable. A drive transmission tube 347 is provided at the tip ends of the protruding arms 346. The drive transmission tube 347 is a tubular member with a helical groove formed therein. The cleaner shaft 33 is screwed into the drive transmission tube 347. When the cleaner shaft 33 rotates by receiving a driving force from the motor (not shown), the cleaning device 34 moves in the axial direction of the cleaner shaft 33 (that is, the longitudinal direction of the charge container 221).

Two guide plates 348, which are plate-like members, respectively protrude from opposite sides of the protruding arms 346. The two guide plates 348 are disposed above the support frame 341 with a certain gap from the top thereof. The top of the charge container 221 is disposed in this gap in a slidably movable manner.

Moreover, sidewalls of the support frame 341 are provided with a pair of tilt shafts 349. The two tilt shafts 349 are coupled to a tiltable arm 350 within the support frame 341. A cleaning pad (not shown) is attached to a lower surface of the tiltable arm 350. The configuration of this cleaning pad is the same as those of the cleaning pads 344*a* and 344*b*. The tiltable arm 350 is biased downward by a bias spring 351. As a result, the cleaning pad presses against the discharge wires 222 from above while removing discharge products adhered to the discharge wires 222.

Of the components described above, an assembly constituted of the support frame 341, the cleaning member 343, and the protruding arms 346 is an example of a device body according to an exemplary embodiment of the present invention. Furthermore, of the components described above, an assembly constituted of the charging device 22 and the cleaning mechanism C is an example of a charging unit according to an exemplary embodiment of the present invention.

Figure 9:
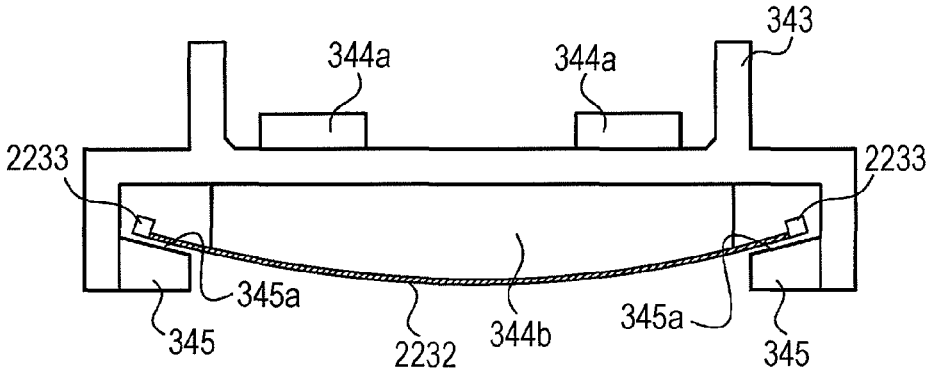
FIG. 9 illustrates the relationship between a cleaning member and the grid member.

FIG. 9 illustrates the relationship between the cleaning member 343 and the grid member 223. The example shown in FIG. 9 illustrates a state where the grid member 223 is being cleaned by the cleaning device 34. Specifically, side portions of the grid member 223 are supported from below by the support members 345 (specifically, the support surfaces 345*a*), and the upper surface of the grid member 223 is pressed and cleaned by the cleaning pad 344*b*. In this state, the grid member 223, which is normally flat, is pressed by the cleaning pad 344*b* so as to be bent toward the photoconductor drum 21 (not shown). Because the support surfaces 345*a* are inclined, as mentioned above, the mesh portion 2232 and the non-mesh portion 2233 of the grid member 223 are both in contact with the support surfaces 345*a*.

Figure 10:
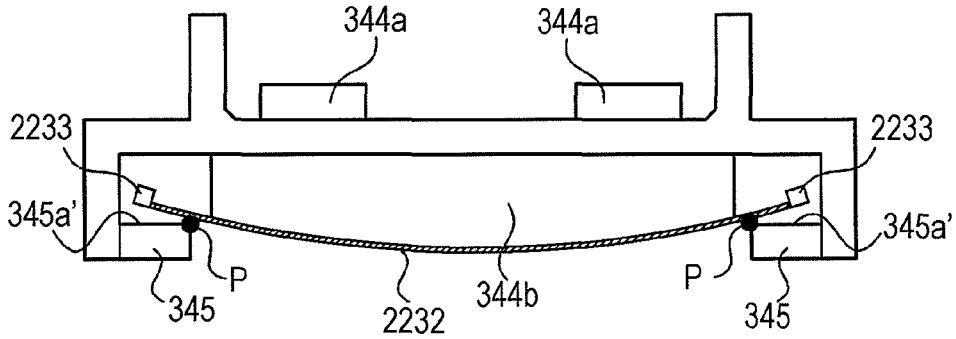
FIG. 10 illustrates the relationship between the cleaning member and the grid member as a comparative example.

FIG. 10 illustrates the relationship between the cleaning member 343 and the grid member 223 as a comparative example. The cleaning member 343 shown in FIG. 10 differs from that in the example shown in FIG. 9 in that support surfaces 345*a*' thereof are not inclined and are thus flat. Although this example also illustrates a state where the grid member 223 is being cleaned by the cleaning device 34, the grid member 223 that is bent by being pressed by the cleaning pad 344*b* is in contact with the support members 345 only at points P since the support surfaces 345*a*' are not inclined. Since the contact area between the grid member 223 and the support members 345 in this example is smaller than that in the example shown in FIG. 9, the contact pressure applied to the points P is larger, as compared with the example shown in FIG. 9.

When the support members 345 move while being in contact with the mesh portion 2232 of the grid member 223, shavings are undesirably produced at the contact regions. This is because the mesh portion 2232 of the grid member 223 has a repeating hexagonal hole pattern, as mentioned above. If the shavings fall on the photoconductor drum 21 and enter the developing device 24, an image defect, such as a color streak or a white streak, may occur. Because the contact pressure applied to a single point of each support member 345 is larger in the example shown in FIG. 10, the amount of shavings produced is greater than that in the example shown in FIG. 9, resulting in a higher possibility of the occurrence of an image detect.

Figure 11:
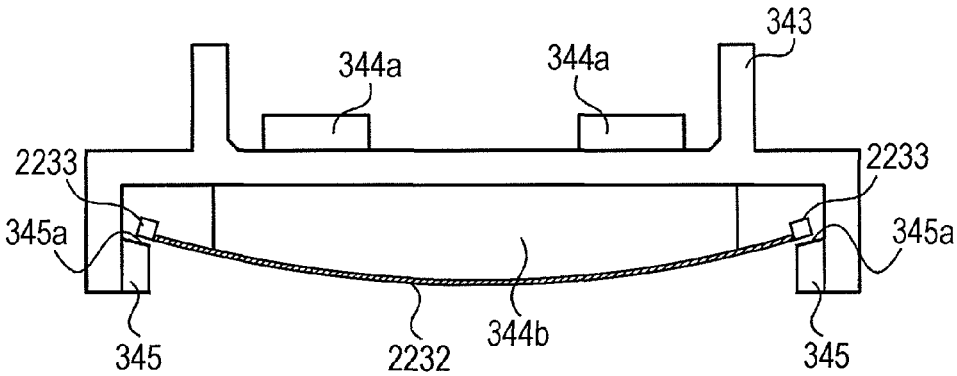
FIG. 11 illustrates the relationship between the cleaning member and the grid member.
Figure 12:
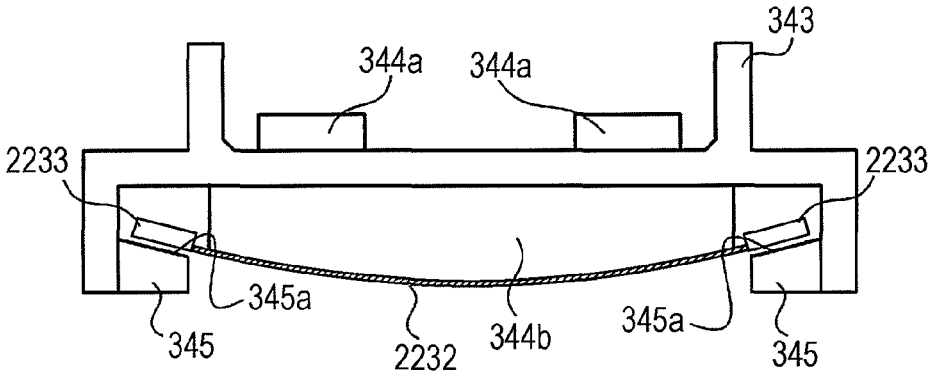
FIG. 12 illustrates the relationship between the cleaning member and the grid member.

One conceivable method of reducing such shavings is preventing the support members 345 from coming into contact with the mesh portion 2232. An example of such a conceivable method includes reducing the protruding length of the support members 345 as compared with the example shown in FIG. 9, as shown in FIG. 11, or increasing the width of the non-mesh portion 2233 of the grid member 223 as compared with the example shown in FIG. 9, as shown in FIG. 12. However, if the support members 345 have the configuration shown in FIG. 11, the contact area between the support members 345 and the grid member 223 becomes smaller than that in the example shown in FIG. 9, making it difficult to stably support the grid member 223, as compared with the example shown in FIG. 9. If the non-mesh portion 2233 of the grid member 223 has the configuration shown in FIG. 12, an area that the mesh portion 2232 occupies the grid member 223 becomes smaller than that in the example shown in FIG. 9. This may be problematic in that the charging efficiency is lowered, as compared with the example shown in FIG. 9. If the same area of the mesh portion 2232 as in the example in FIG. 9 is to be ensured for preventing reduced charging efficiency, the charging device 22 would undesirably become larger in size than that in the example in FIG. 9.

Due to the above reasons, it is conceivable that the occurrence of shavings may be effectively minimized by reducing the contact pressure applied to contact points between the support members 345 and the mesh portion 2232 rather than preventing the support members 345 from being in contact with the mesh portion 2232. Specifically, the contact pressure may be reduced by setting the support members 345 in contact with both the mesh portion 2232 and the non-mesh portion 2233.

Figure 13:
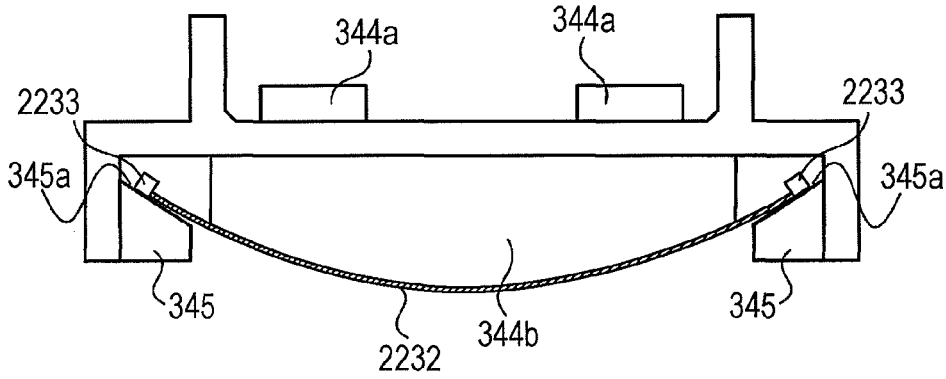
FIG. 13 illustrates the relationship between the cleaning member and the grid member.

The inclination angle of the support surfaces 345*a* of the support members 345 may be set in accordance with the curvature of the grid member 223 that is pressed and bent by the cleaning pad 344*b*. For example, referring to FIG. 13, if the grid member 223 is bent by a large amount, the support surfaces 345*a* may be given an inclination angle that is larger than that in the example in FIG. 9. In this case, of the components constituting the grid member 223, the mesh portion 2232 has a shape with a higher tendency to produce shavings than the non-mesh portion 2233. Therefore, as shown in FIG. 13, the inclination angle of the support surfaces 345*a* may be set such that the contact pressure applied to areas of the support surfaces 345*a* that are in contact with the mesh portion 2232 is smaller than the contact pressure applied to areas of the support surfaces 345*a* that are in contact with the non-mesh portion 2233.

Figure 14:
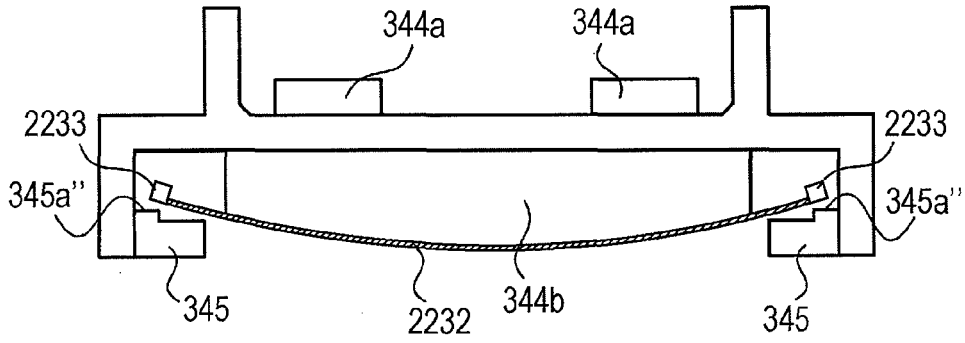
FIG. 14 illustrates the relationship between the cleaning member and the grid member.

As an alternative to the support surfaces 345*a* that are inclined as shown in FIG. 9, the support members 345 may have stepped support surfaces 345*a*" as shown in FIG. 14. In this case, areas of the support surfaces 345*a*" that are in contact with the mesh portion 2232 may be beveled. Furthermore, the number of steps in each stepped support surface 345*a*" may be three or more.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a device body that is configured to move in a longitudinal direction of a plate-like grid member of a charging device;

a cleaning member that is disposed in the device body and cleans a first face of the grid member while pressing against the first face when the device body is moved; and a support member that is provided in the device body and comprising an inclined support surface that is in contact with and configured to support a second face opposite to the first face of the grid member pressed by the cleaning member, the inclined support surface being in contact with a mesh portion and a non-mesh portion of the grid member, wherein the inclined support surface is inclined relative to a width direction of the grid member.

2. The cleaning device according to claim 1, wherein the inclined support surface is inclined relative to a width direction of the grid member when not pressed by the cleaning member.

3. The cleaning device according to claim 2, wherein an inclination angle of the inclined support surface is set such that contact pressure applied to an area of the inclined support surface that is in contact with the mesh portion of the grid member is smaller than contact pressure applied to an area of the inclined support surface that is in contact with the non-mesh portion of the grid member.

4. A charging unit comprising:

a unit body;

the cleaning device according to claim 1 that is disposed within the unit body;

a grid member that is disposed in a longitudinal direction of the unit body and is cleaned by the cleaning member of the cleaning device; and a discharge member that is disposed in the longitudinal direction of the unit body and releases electric charge to an image bearing member via the grid member.

5. An image bearing unit comprising:

the charging unit according to claim 4;

an image bearing member that is supplied with electric charge from the discharge member of the charging unit and that bears an image; and a cleaning unit that cleans a surface of the image bearing member.

6. An image forming apparatus comprising:

the image bearing unit according to claim 5;

an exposure device that exposes a surface of the image bearing member of the image bearing unit to light so as to form a latent image;

a developing device that develops the latent image formed on the surface of the image bearing member by the exposure device;

a transfer member that transfers the image formed on the surface of the image bearing member by the developing device onto a recording medium; and a fixing device that fixes the image transferred to the recording medium by the transfer member onto the recording medium.

* * * * *